US007300321B2

(12) United States Patent
Phillips et al.

(10) Patent No.: US 7,300,321 B2
(45) Date of Patent: Nov. 27, 2007

(54) EARLY WARNING AND PROTECTION FOR HEAT EXCHANGE SYSTEMS

(75) Inventors: David L. Phillips, Santa Ana, CA (US); Ned Santos, Lake Forest, CA (US); William B. McDonough, Huntington Beach, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 4 days.

(21) Appl. No.: 11/342,304

(22) Filed: Jan. 26, 2006

(65) Prior Publication Data

US 2006/0217873 A1 Sep. 28, 2006

Related U.S. Application Data

(60) Provisional application No. 60/647,533, filed on Jan. 26, 2005.

(51) Int. Cl.
*B63H 21/22* (2006.01)

(52) U.S. Cl. ..... 440/1; 440/2

(58) Field of Classification Search ..... 440/1, 440/2

See application file for complete search history.

(56) References Cited

U.S. PATENT DOCUMENTS

| | | | | |
|---|---|---|---|---|
| 4,019,489 | A * | 4/1977 | Cartmill | 123/198 D |
| 4,598,278 | A * | 7/1986 | Ford | 340/608 |
| 5,237,310 | A | 8/1993 | Smith | |
| 5,332,366 | A | 7/1994 | Anderson | |
| 5,720,598 | A | 2/1998 | de Chizzelle | |
| 6,260,004 | B1 | 7/2001 | Hays et al. | |
| 6,390,779 | B1 | 5/2002 | Cunkelman | |
| 2003/0133808 | A1 | 7/2003 | Sabini et al. | |
| 2004/0127109 | A1 * | 7/2004 | Matsuda | 440/1 |

* cited by examiner

*Primary Examiner*—Stephen Avila

(57) ABSTRACT

Method and apparatus are provided for warning a user or operator about a malfunction in a pump and/or engine of a marine vessel or another suitable device or equipment, featuring steps of: comparing a sensed pressure differential at a sensed RPM when the pump/engine is running to a learned database having a pressure differential versus RPM curve; and providing an indication to the operator when there is a change in the relationship that exceeds a predetermined relationship. The apparatus may include an active intelligence unit or module for making the comparison and providing the indication according to the invention.

33 Claims, 2 Drawing Sheets

EARLY WARNING AND PROTECTION FOR HEAT EXCHANGE SYSTEMS

CROSS-REFERENCE TO RELATED APPLICATIONS

This application is related to a corresponding application filed on the same day as the present application and identified by a patent application Ser. No. 60/647,533, filed 26 Jan. 2005 which is hereby incorporated by reference in its entirety.

BACKGROUND OF THE INVENTION

1. Technical Field

The present invention relates to a method and apparatus for warning a user or operator about a malfunction in a marine vessel or another suitable device or equipment, including a malfunction of an engine in a heat exchange system for a marine vessel or other suitable non-marine vessel.

2. Description of Related Art

Currently, known devices warn a user after an engine of a marine vessel or other suitable has overheated, and damage has occurred or is imminent. The engine has a pump that supplies a cooling system with water to take the heat away. Current known methods include alerting the user when the engine has overheated.

In view of this, there is a need in the art for a method and apparatus for warning the user or operator before the engine for a marine vessel or other suitable non-marine apparatus, including a heat exchange system in such a vessel or apparatus, has overheated, or is damaged.

SUMMARY OF THE INVENTION

The present invention provides a new and unique method and apparatus for warning a user or operator about a malfunction in an engine of a marine vessel or another suitable device or equipment, including a malfunction in a heat exchange system for a marine vessel, as well as other suitable non-marine vessel such as industrial equipment and circulation and industrial applications. The method features steps of sensing a relationship between two parameters, such as a pressure differential and the RPMs of the engine, when the engine is running, and providing an indication to the user or operator when there is a change in the relationship that exceeds a predetermined relationship. The pressure differential is measured between the inlet and outlet of the water cooling system of the engine. The indication includes shutting off the pump and/or engine, or providing an audible or visual alarm warning, or some combination thereof, including providing information about the malfunction. The method also includes learning the predetermined relationship and storing the same in a memory device, as well as updating the predetermined relationship based on a given set of parameters as the pump/engine continues to run. The invention also includes apparatus for performing the steps of such a method.

In particular, the present invention provide a method and apparatus for warning a user or operator about a malfunction in a pump and/or engine of a marine vessel or another suitable device or equipment, wherein the method includes the steps of:

comparing a sensed pressure differential at a sensed RPM when the pump/engine is running to a learned database having a pressure differential versus RPM curve; and providing an indication to the operator when there is a change in the relationship that exceeds a predetermined relationship.

The apparatus may include an active intelligence unit or module for making the comparison and providing the indication according to the invention.

The pressure differential versus RPM curve may be updated in the learned database based on the sensed pressure differential at the sensed RPM, and is built in the learned database using a multiplicity of sensed pressure differentials at sensed RPMs.

The method includes mounting a first transducer at an inlet side of the heat exchange system and mounting a second transducer at an outlet side of the heat exchange system, for providing first and second transducer signal from the first and second transducers to an active intelligence module for determining the sensed pressure differential; as well as mounting an RPM sensor in relation to the engine, for providing an RPM sensor signal from the RPM sensor to an active intelligence module for determining the sensed RPM.

The learned database may also include the number of operating hours of the engine that is used to determine if the change in the relationship exceeds the predetermined relationship, including providing a service warning when the number of operating hours exceeds a predetermined number, as well as types and numbers of malfunctions detected in the engine that are used to determine if the change in the relationship exceeds the predetermined relationship.

In operation, a plurality of sensed pressure differentials at sensed RPMs may be compared to the pressure differential versus RPM curve in the learned database to determine if the change in the relationship exceeds the predetermined relationship, and the pressure differential versus RPM curve in the learned database may include more than one pressure differentials at each RPM. The method may also include using a separate learned database having a separate pressure differential versus RPM curve for each pump/engine in a multi-engine system.

In effect, utilizing either pressure/vacuum switches or transducers and pump RPM, one can utilize the functionality of an active sensing and switching device to profile the function of the pump/engine cooling and provide an immediate response to pump problems, failure open lines etc. in the system, eliminating the need for the system to overheat before alerting the user and other pump applications. The system can detect not only failures but also degradation to alert the user of low performance, which can aid in preventive maintenance leading to cost savings over time.

Applications of the present invention include marine engine cooling, industrial equipment, circulation applications, and industrial applications such as factories.

One advantage of the present invention is that it allows the user to know immediately when the cooling pump has issues rather than when the pump/engine has over heated and sets off the alarm. Preventing the need for the pump/engine to overheat prior to being alerted or to pump failure prior to being alerted.

BRIEF DESCRIPTION OF THE DRAWING

The drawing includes the following Figures, that are not necessarily drawn to scale.

BEST MODE FOR CARRYING OUT THE INVENTION

Figure 1:
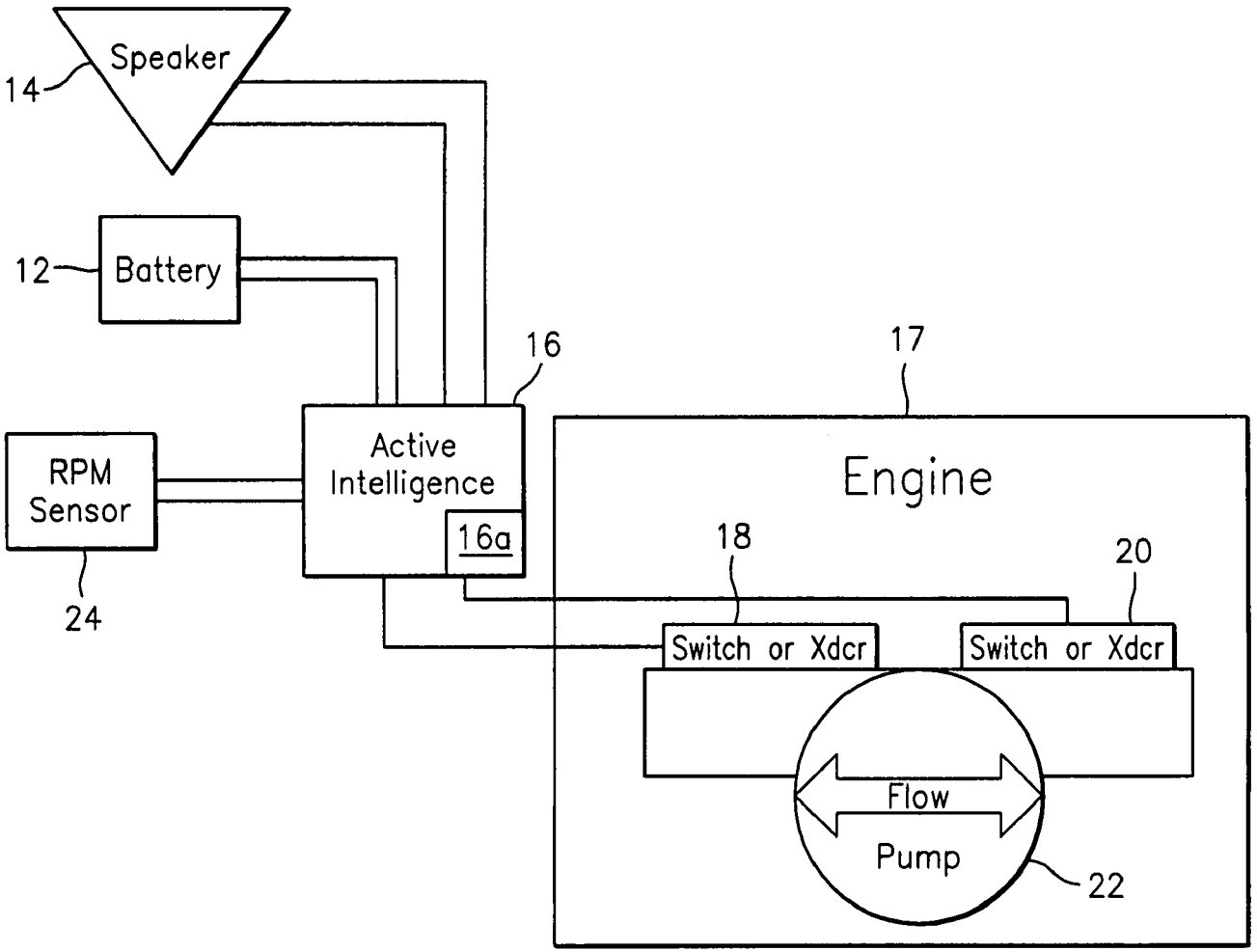
FIG. 1 shows a block diagram of a heat exchange system according to the present invention.

FIG. 1 shows a block diagram of a heat exchange system generally indicated as 10 according to the invention, which includes a battery 12, an alarm 14, an active intelligence unit or module 16 (having a learned database 16*a*), and an engine or engine system 17 that has a first switch or transducer 18, a second switch or transducer 20, a pump 22, and an RPM sensor 24.

Figure 2:
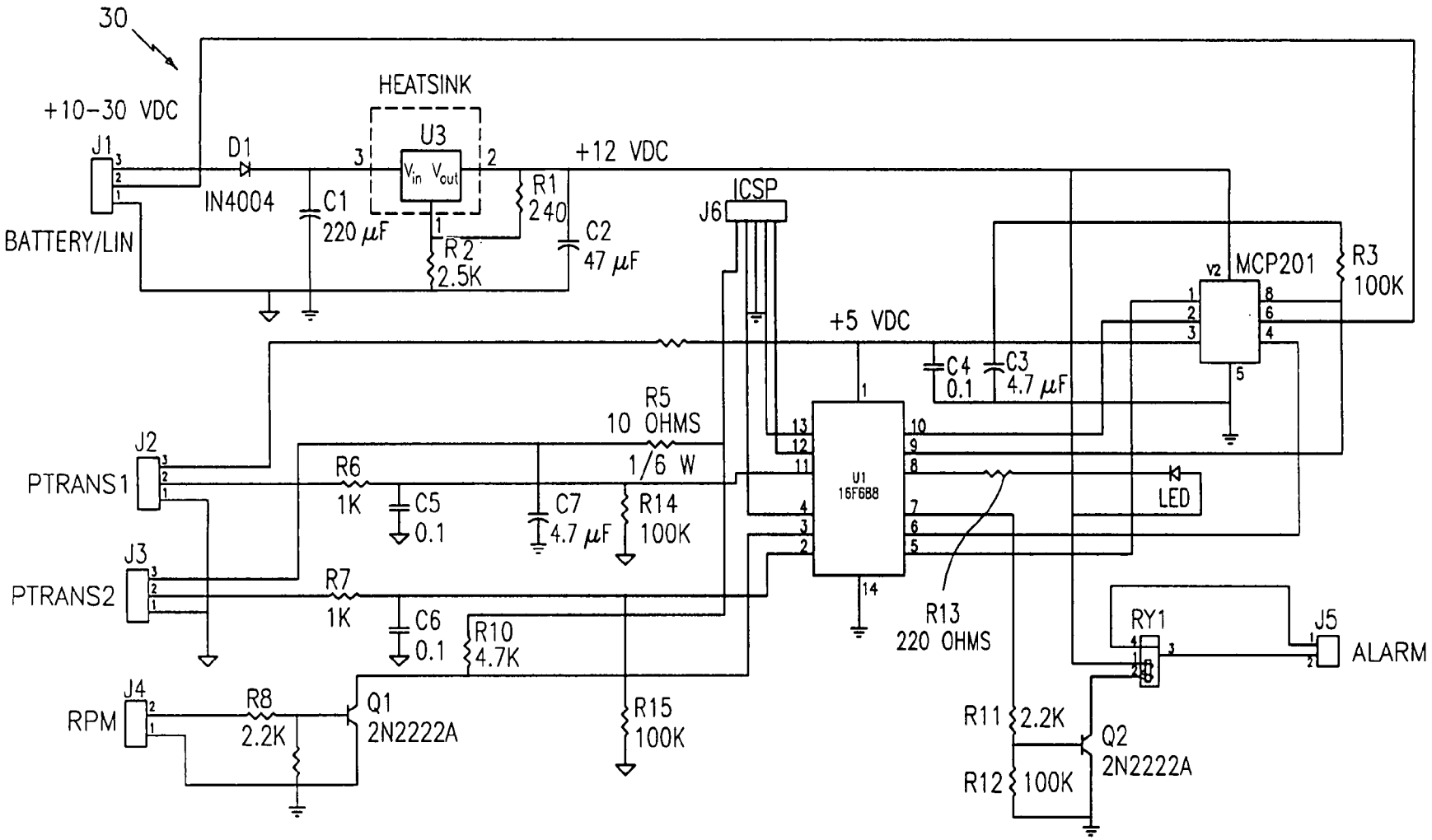
FIG. 2 is a circuit for implementing the active intelligence 16 shown in FIG. 1.

FIG. 2 shows, by way of example, a circuit generally indicated as 30 for implementing the active intelligence 16 shown in FIG. 1. The circuit 30 includes an advanced 8-pin microcontroller (U1) with mixed signal and enhanced communications peripherals. It is a modern microcontroller utilizing 4K of flash-based program memory, 256 bytes of random access memory (RAM) for temporary variable storage, 256 bytes of EEPROM memory for non-volatile variable storage, an on-chip 8-channel 10-bit analog to digital converter (ADC) with sample and hold, an enhanced universal synchronous/asynchronous receiver/transmitter (EUSART), and a high-current general purpose I/O. In a preferred embodiment, the Microchip Technology PIC16F688 device would be used, although other similar devices from Freescale Semiconductor (Motorola), Atmel, Texas Instruments, Renasis, etc. are also useable in this application.

The LIN (Local Interconnect Network) transceiver U2 is designed to level-shift the logic levels of the microcontroller to the +12 volt levels of the bi-directional LIN bus, a low speed bidirectional communications bus. It also has an internal +5 VDC regulator to provide power to the advanced 8-pin microcontroller U1 and the pressure transducers.

The Voltage regulator U3 regulates the incoming 12/24 VDC input to a constant 12 VDC and protects the low-level circuitry from high-voltage incoming spikes. Separate digital and analog grounds are used to allow more precise analog measurements to be made without being affected by noise and ground currents on the digital power ground.

The inputs to the system 10 include the two separate pressure transducers 18 and 20, which measure the inlet and outlet pressures of the water on intake and outlet of the cooling pump 22. Also there is an RPM input from the RPM sensor 24 from the motor to indicate the rotations per minute thereof.

The outputs from the circuit 30 include an external alarm output (ALARM) to active a remote, loud audible circuit, and a simple light emitting diode (LED) to act as an internal status and diagnostic LED. In an alternative embodiment, the LED display may also be replaced by an LCD screen which can show status and also give pump particulars such as life of impeller, run time, etc.

Detailed Circuit Description

In operation, power for the circuit 30 may be supplied from the vehicle or vessel battery, typically a 24 VDC battery source, although the circuit 30 can also be operated from 10-30 VDC. The power is applied via a connector J1. The diode D1 (1N4004) acts a reverse-protection diode that only allows current to pass to the circuit IF the polarity ("+" and "−") from the battery is correct; else it blocks the reverse voltage. The three-terminal linear voltage regulator U3, such as an LM317, regulates the incoming voltage, typically 24 VDC for a diesel engine system, down to +12 VDC. The regulator U3 also isolates the remaining circuits from voltage transients up to 60V and dropouts. The capacitor C1, typically 220 microfarads (uF), is the main input voltage filtering capacitor that also protects against momentary blackouts by holding a charge when the input voltage is less than the stored voltage on the cap. The capacitor C2 on the regulator output filters and decouples the balance of the circuitry connected to the regulator U3.

The LIN-BUS compatible transceiver chip U2 shifts the outgoing logic level transmit data from +5 to +12 levels and shifts the incoming data from +12 to +5V logic levels, and also provides high current drive and fault protection for the system.

Two identical pressure transducers (PTRANS1, PTRANS2) are connected to the system via connectors J2 and J3. These transducers produce an output voltage proportional to the water pressure applied to their input. The resistors R6/R7 and capacitors C5, C6 provide a simple low pass filter to reduce the effects of electrical noise on the desired signals from the transducers. They all protect the microcontroller U1 from possible damaging voltage transients. The resistors R14, R15 provide a high impedance path to ground so that the signal voltage will not be "floating" if the pressure transducer wires are broken.

The transistor Q2 along with the resistors R11, R12 level shift the logic levels of microcontroller U1 to +12V at about 100 milliamperes (mA) of current to drive the relay RY1. The relay RY1 in turn can activate an external loud audible alarm and/or light as a warning to the pilot or other operators of a potentially catastrophic malfunction of the engine cooling system.

The RPM engine sensor (RPM) 24 (FIG. 1) is connected to the connector J4 to provide pulses whose rate is proportional to the speed of the engine. The transistor Q1 along with resistors R8, R9 and R10 condition this signal and isolate the microcontroller U1 from potentially damaging voltage transients that may be present on the wiring.

The LED LD1 along with the resistor R13 allow the microcontroller U1 to indicate proper operation or malfunction visibly by displaying a steady or blinking light source.

Software & System Operation

Basically, the system monitors RPMs from the engine (one active intelligence (AI) 16 for each engine in a multi-engine boat) to determine if the engine is running or not and how fast. It monitors the pressure signals from the two pressure transducers. The transducer PTRANS1 is mounted at the inlet of the water-cooling system and normally is connected to produce a positive output if there is a vacuum present, indicating the pump is working properly. Transducer PTRANS2 is mounted at the outlet of the water-cooling system and produces a positive voltage output when a pressure is present, indicating that the pump 22 is moving sufficient water to produce a pressure in the closed plumbing system.

On a normally functioning system, there will be a pressure differential between the two transducers that varies with the engine RPM. The AI engine cooling system 16 will monitor this pressure curve as well as accumulate operating hours of the cooling system. It communicates this information bi-directionally over a low-cost low speed LIN bus network to other monitoring and display equipment, such as a Gemini or other suitable system. If a serious malfunction is detected, the active intelligence system 16 will also activate the loud remote audible alarm 14 and/or bright remote light to indicate that serious damage may be occurring to the power train of the vehicle.

This active intelligence system 16 according to the invention is capable of "learning" the normal pressure differential versus RPM curve of the particular engine to which it is connected so that it may more accurately determine changes from "normal" for its particular environment. It maintains a target baseline curve in pre-programmed memory and can acquire its actual curve to store in non-volatile EEPROM memory. Normally operating time is stored in this EEPROM memory and well as types and numbers of malfunctions detected for use in a history record of the cooling system of the engine.

Some different malfunctions may be detected as follows:

For example, if there are RPM pulses present, indicating that the engine is "running", or if there is a very small or no pressure differential detected, this likely means the pump has failed completely, possibly from a broken power take off or a broken impeller. This is diagnosed as a very serious problem and the alarm is activated.

If there is a low vacuum on the inlet side, possibly the water source is broken or occluded, this is diagnosed as a very serious problem and the alarm is activated.

If there is excessively high pressure on the outlet side with normal vacuum on the inlet side, then there is possible an occlusion or blockage in the outlet plumbing.

If there is pressure drop detected on the outlet side that is significantly less than the "normal" pressure at a given RPM, possible the impeller is degrading (losing blades) or there may be a serous water leak on the outlet side.

Even if all parameters are normal, when the operating time exceeds the expected life of the pump, or when the operating time reaches a normal service interval, this information is communicated via the LIN bus and a momentary "beep" of the external alarm to alert the operator that normal service is recommended. This is a desirable, pro-active feature to prevent future failures that may occur in the FUTURE when the vehicle, such as a boat, may be far out a sea.

Interrogation of the Unit or Module 16 is Possible

The unit or module 16 is also capable of being interrogated via a personal computer, laptop, or personal digital assistant (PDA) with suitable serial interface to convert LINBUS to USB or other standard interface. It may also be made LIN to NMEA 0183 compliant with a simple converter interface as well. The communications data rate is 4800 baud, compatible with NMEA 0183.

Implementation of the Functionality of the Module 16

Consistent with that described herein, including that shown and described above in relation to FIG. 2, the functionality of the active intelligence module 16, including the microcontroller U1 (FIG. 2) may be implemented using hardware, software, firmware, or a combination thereof, although the scope of the invention is not intended to be limited to any particular embodiment thereof. In a typical software implementation, the module 16 would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology now known or later developed in the future. Moreover, the scope of the invention is intended to include the module 16 being a stand alone modules, as shown, or in the combination with other circuitry for implementing another module.

The Scope of the Invention

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein without departing from the spirit and scope of the present invention.

The invention claimed is:

1. A method for warning an operator about a malfunction in a pump and/or engine of a marine vessel or another suitable device or equipment, including a malfunction in a heat exchange system of the engine for a marine vessel or other suitable non-marine vessel, as well as other suitable non-marine vessel such as industrial equipment and circulation and industrial applications, characterized in that the method includes the steps of:

comparing a sensed pressure differential at a sensed RPM when the pump/engine is running to a learned database having a pressure differential versus RPM curve; and providing an indication to the operator when there is a change in the relationship that exceeds a predetermined relationship.

2. A method according to claim 1, wherein the pressure differential versus RPM curve is updated in the learned database based on the sensed pressure differential at the sensed RPM.

3. A method according to claim 1, wherein the pressure differential versus RPM curve is built in the learned database using a multiplicity of sensed pressure differentials at sensed RPMs.

4. A method according to claim 1, wherein the method includes mounting a first transducer at an inlet side of the heat exchange system and mounting a second transducer at an outlet side of the heat exchange system.

5. A method according to claim 4, wherein the method includes providing first and second transducer signal from the first and second transducers to an active intelligence module for determining the sensed pressure differential.

6. A method according to claim 1, wherein the method includes mounting an RPM sensor in relation to the engine, and providing an RPM sensor signal from the RPM sensor to an active intelligence module for determining the sensed RPM.

7. A method according to claim 1, wherein the learned database includes the number of operating hours of the pump/engine that is used to determine if the change in the relationship exceeds the predetermined relationship, including providing a service warning when the number of operating hours exceeds a predetermined number.

8. A method according to claim 1, wherein the learned database includes types and numbers of malfunctions detected in the pump/engine that are used to determine if the change in the relationship exceeds the predetermined relationship.

9. A method according to claim 1, wherein a plurality of sensed pressure differentials at sensed RPMs are compared to the pressure differential versus RPM curve in the learned database to determine if the change in the relationship exceeds the predetermined relationship.

10. A method according to claim 1, wherein the pressure differential versus RPM curve in the learned database includes more than one pressure differentials at each RPM.

11. A method according to claim 1, wherein the method includes using a separate learned database having a separate pressure differential versus RPM curve for each pump/engine in a multi-engine system.

12. A method according to claim 1, wherein the learned database is stored in an active intelligence module that may be interrogated using a personal computer, laptop, personal digital assistant (PDA) or other suitable device.

13. A method according to claim 1, wherein the learned database includes a target baseline curve containing information about target pressure differential versus RPM.

14. A method according to claim 1, wherein the indication is an audio or visual warning.

15. Apparatus for warning an operator about a malfunction in a pump and/or engine of a marine vessel or another suitable device or equipment, including a malfunction in a heat exchange system for a marine vessel or other suitable non-marine vessel, as well as other suitable non-marine vessel such as industrial equipment and circulation and industrial applications, characterized in that the apparatus includes:

an active intelligence module for comparing a sensed pressure differential at a sensed RPM when the pump/engine is running to a learned database having a pressure differential versus RPM curve; and a device for providing an indication to the operator when there is a change in the relationship that exceeds a predetermined relationship.

16. Apparatus according to claim 15, wherein the pressure differential versus RPM curve is updated in the learned database based on the sensed pressure differential at the sensed RPM.

17. Apparatus according to claim 15, wherein the pressure differential versus RPM curve is built in the learned database using a multiplicity of sensed pressure differentials at sensed RPMs.

18. Apparatus according to claim 15, wherein the method includes mounting a first transducer at an inlet side of the heat exchange system and mounting a second transducer at an outlet side of the heat exchange system.

19. Apparatus according to claim 18, wherein the method includes providing first and second transducer signal from the first and second transducers to an active intelligence module for determining the sensed pressure differential.

20. Apparatus according to claim 15, wherein the method includes mounting an RPM sensor in relation to the engine, and providing an RPM sensor signal from the RPM sensor to an active intelligence module for determining the sensed RPM.

21. Apparatus according to claim 15, wherein the learned database includes the number of operating hours of the pump/engine that is used to determine it the change in the relationship exceeds the predetermined relationship, including providing a service warning when the number of operating hours exceeds a predetermined number.

22. Apparatus according to claim 15, wherein the learned database includes types and numbers of malfunctions detected in the pump/engine that are used to determine if the change in the relationship exceeds the predetermined relationship.

23. Apparatus according to claim 15, wherein a plurality of sensed pressure differentials at sensed RPMs are compared to the pressure differential versus RPM curve in the learned database to determine if the change in the relationship exceeds the predetermined relationship.

24. Apparatus according to claim 15, wherein the pressure differential versus RPM curve in the learned database includes more than one pressure differentials at each RPM.

25. Apparatus according to claim 15, wherein the method includes using a separate learned database having a separate pressure differential versus RPM curve for each pump/engine in a multi-engine system.

26. Apparatus according to claim 15, wherein the learned database is stored in an active intelligence module that may be interrogated using a personal computer, laptop, personal digital assistant (PDA) or other suitable device.

27. Apparatus according to claim 15, wherein the learned database includes a target baseline curve containing information about target pressure differential versus RPM.

28. Apparatus according to claim 15, wherein the indication is an audio or visual warning.

29. A method for warning the user about a malfunction in a pump/engine of a marine vessel or another suitable device or equipment, including a malfunction in a heat exchange system of the pump/engine for a marine vessel or other suitable non-marine vessel, as well as other suitable non-marine vessel such as industrial equipment and circulation and industrial applications, characterized in that the method includes the steps of:

sensing a relationship between two parameters when the pump/engine is running, including a pressure differential and the RPMs of the engine, the pressure differential being measured between an inlet and outlet of a water cooling system of a pomp in the engine; and providing an indication to the user when there is a change in the relationship that exceeds a predetermined relationship.

30. A method according to claim 29, wherein the indication includes shutting off the engine.

31. A method according to claim 29, wherein the indication includes providing an audible or visual alarm warning, or some combination thereof, including providing information about the malfunction.

32. A method for warning the user about a malfunction in a pump/engine of a marine vessel or another suitable device or equipment, including a malfunction in a heat exchange system of the pump/engine for a marine vessel or other suitable non-marine vessel, as well as other suitable non-marine vessel such as industrial equipment and circulation and industrial applications, characterized in that the method includes the steps of:

sensing a relationship between two parameters when the pump/engine is running, including a pressure differential and the RPMs of the engine;

providing an indication to the user when there is change in the relationship that exceeds a predetermined relationship; and learning the predetermined relationship and storing the same in a memory device.

33. A method for warning the user about a malfunction in a pump/engine of a marine vessel or another suitable device or equipment, including a malfunction in a heat exchange system of the pump/engine for a marine vessel or other suitable non-marine vessel, as well as other suitable non-marine vessel such as industrial equipment and circulation and industrial applications, characterized in that the method includes the steps of:

sensing a relationship between two parameters when the pump/engine is running, including a pressure differential and the RPMs of the engine;

providing an indication to the user when there is a change in the relationship that exceeds a predetermined relationship; and updating the predetermined relationship based on a given set of parameters as the pump/engine continues to run.

* * * * *

UNITED STATES PATENT AND TRADEMARK OFFICE

CERTIFICATE OF CORRECTION

PATENT NO. : 7,300,321 B2
APPLICATION NO. : 11/342304
DATED : November 27, 2007
INVENTOR(S) : David L. Phillips, Ned Santos and William B. McDonough It is certified that error appears in the above-identified patent and that said Letters Patent is hereby corrected as shown below:

1.) In column 7, line 57, Claim 21, line 3 “it” should be --if--
2.) In column 8, line 58, Claim 32, line 12 after “is” --a-- should be inserted Signed and Sealed this Nineteenth Day of August, 2008

JON W. DUDAS
*Director of the United States Patent and Trademark Office*